US005823900A

United States Patent [19]

Harren et al.

[11] Patent Number: 5,823,900

[45] Date of Patent: Oct. 20, 1998

[54] PROCESS AND DEVICE FOR BRINGING INTO ALIGNMENT THE STRINGS OF AN INTERLACED NETWORK

[76] Inventors: Ernst-Diethelm Harren, Salmanusstrasse 39, Würselen D-52146, Germany; Christian Bangert, Bismarckstrasse 150, Aachen D-52066, Germany

[21] Appl. No.: 687,350

[22] PCT Filed: Jan. 15, 1995

[86] PCT No.: PCT/DE95/00052

§ 371 Date: Jul. 19, 1996

§ 102(e) Date: Jul. 19, 1996

[87] PCT Pub. No.: WO95/19816

PCT Pub. Date: Jul. 27, 1995

[30] Foreign Application Priority Data

Jan. 19, 1994 [DE] Germany ..... 44 01 445.7

[51] Int. Cl.[6] ..... A63B 51/00

[52] U.S. Cl. ..... 473/553

[58] Field of Search ..... 473/524, 553, 473/557

[56] References Cited

U.S. PATENT DOCUMENTS

| | | | |
|---|---|---|---|
| 4,089,523 | 5/1978 | Newburger | 473/553 |
| 4,489,942 | 12/1984 | Kent | 473/553 |
| 4,733,866 | 3/1988 | Herbert | 473/553 |
| 4,989,864 | 2/1991 | Ubl | 473/553 |
| 5,310,181 | 5/1994 | Chan | 473/553 |
| 5,441,258 | 8/1995 | Pagan | 473/553 |

*Primary Examiner*—William E. Stoll
*Attorney, Agent, or Firm*—Thomas R. Vigil

[57] ABSTRACT

The device (1) is used for aligning the strings of the netting, and particularly the netting of a tennis racket. In order to align the strings of the netting in a simple, accurate, quick and effortless manner, without damaging the strings, the aligning device has semi-ellipsoidal, semi-circular or oval platelets that act on the strings at their crossing points.

18 Claims, 4 Drawing Sheets

PROCESS AND DEVICE FOR BRINGING INTO ALIGNMENT THE STRINGS OF AN INTERLACED NETWORK

The invention relates to a first device for bringing into alignment the strings of an interlaced network with a base plate and a number of aligning elements, whereas the aligning element is designed as a thin plate which catches hold of the strings near their intersection, a second device for brining into alignment the strings of an interlaced network with a base plate and a number of aligning elements, whereas the aligning element has a tapered aligning area for aligning the strings, this aligning area being bent parallely to the base plate in such a way that the aligning element touches the string to be aligned nearly punctually, as well as a holding area with two parallely arranged flat sides holding at least one string, a third device for bringing into alignment the strings of an interlaced network with a base plate and a number of aligning elements being, in their outline, either semi-elliptical, semi-circular or of the shape of a tapered pointed arch and a method for bringing into alignment the strings of an interlaced network with an aligning device, the aligning device being first pressed into the interlaced network with its aligning elements.

Such a first device is known from DE-GM 88 01 337, such a method and such a second device from U.S. Pat. No. 4,733,866 and such a method and such a third device from FR 2,661.102.

The stringing of rackets of ball-games, for example tennis-rackets, squash-rackets, badminton-rackets and the like changes during the game due to the shifting of the strings of the interlaced network under the impact of the ball. Due to this shifting of the strings, the quality of the stringing changes disadvantageously. That is why the players can often be seen, at half-time, trying, with little success, to reset the strings.

In the past, devices have been suggested to align the strings of an interlaced network, especially of tennis-rackets. Those of most importance will briefly be discussed in the following:

In DE-GM 88 01 337 a device for aligning the stringing of a racket has been disclosed which catches hold of the strings at their intersection. Therefore, aligning elements consisting of thin plates and with flattened sloping sides are arranged onto a base plate. The aligning elements are hereby flattened in such a way that the thin plate has a triangular outer shape. The plates are thereby arranged onto the base plate so that they occupy each second window of a row and a column.

This aligning device cannot align the strings of a tennis-racket with the necessary accuracy, as it cannot bring the strings up to the base plate. Although, the strings are brought up to the base plate on the edge of the stringing, this is not achieved in the most important area, that is to say in the center part of the stringing, as the force exerted onto the string causes this same string to lengthen and to bend away from the base plate, due to its elasticity. Thus, between each string in the center part of the interlaced network and the base plate a gap of a few millimeters remains, rendering a precise alignment of the strings impossible.

A second problem consists in that the oblique bevelled faces of the plate form, together with the side faces, a sharp edge, which can damage and even cut through the strings.

U.S. Pat. No. 4,733,866 disclosed a portable device for aligning the strings of tennis-rackets touching the string to be aligned nearly punctually, the touching point being located more or less in the middle between two adjacent intersection knots. This device for aligning strings has spaced aligning elements being arranged in only one row. These aligning elements have a bottom area with a square section, side faces being arranged vertically to the base and a top area having either a shell or a pyramidal shape with bent wall faces. The transition between top and bottom area forms an edge.

FR 2,661,102 discloses a device for aligning strings having only three rows and five columns and in which the aligning elements are arranged symmetrically to the axis of rotation and have a cylindrical-pointed arch shape. Moreover, they are fastened onto the base plate with a lot of play.

The meshes or windows of a tennis-racket-stringing in particular are usually rectangular and vary in size. Thus, they do not correspond to the square (U.S. Pat. No. 4,733,866) or circular (FR-2,661,102) section of the aligning elements. Thus, it is not possible, with the aligning devices of the state, to bring back the stringing into its precise original shape, since the aligning elements align the opposite strings of a mesh into a square mesh. But this does not comply with the original spacing of the strings. The strings rather risk to be moved even further out of shape by the aligning elements, these being, at least in one direction, bigger than the mesh itself. Thus, the original quality of hitting cannot be restored by the aligning devices of the state of the art.

Even the proposed repeated insertion of the aligning device into the stringing can only roughly align the strings, even if the aligning device is twisted or shifted.

Therefore, the object of the present invention is to provide a device and a method for brining into alignment the strings of an interlaced network, which aligns the strings of the network easily, precisely, rapidly, without too much effort and without damaging the strings.

A technical solution of this object is to work out the above-mentioned, first device in such a way that the aligning element has rounded short sides and that the short sides pass smoothly from an elliptical or semi-circular aligning area for string alignment into a holding area with short sides running at least nearly perpendicularly to the base plate.

The aligning area is the area of the aligning element touching the string to be aligned during the aligning procedure, whereas the holding area defines the area in which the string is placed when the alignment is almost achieved.

The holding area according to the invention comprises also the area of an ellipse, of a semi-circle or the like, whose tangent runs nearly vertically to the base plate.

A device worked out according to this state of the art has the advantage to align evenly the string to be aligned thanks to the elliptical or semi-circular aligning area and to the smooth transition from the aligning to the holding area. Thus, the work needed for the alignment is distributed over the whole aligning process, so that the maximal force to be exerted is small.

The holding area provided for at the end of the plate near to the base plate has the advantage that the string can be aligned precisely, since, due to the holding area with its side walls, arranged nearly vertically to the base plate, it is guaranteed that, at the end of the aligning process, all the strings have reached the holding area and are located in their aligned position, even though not all of them are touching the base plate, due to the arch of the interlaced network.

Further advantages of the aligning device according to the invention are that such aligning elements can be inserted diagonally into a window of the network, in order to align with the short side of the plate nearly simultaneously both strings of an intersection, this method reducing the force needed and facilitating a precise alignment and that, thanks to the rounded short sides, the strings cannot be damaged by sharp-edged aligning elements.

Since some windows have nearly the same diagonal length, even if their dimensions are different, the thin plate has also the advantage that it can be fitted in several windows, so that less plates of different size are needed in order to align all the windows of the stringing.

Another technical solution of this object is to work out the above-mentioned second device so that, perpendicularly to the base plate, the aligning area is designed elliptically or semi-circularly, that the holding area has two transversal sides connecting the flat sides, these transversal sides being curved to touch the strings to be aligned punctually, that the flat sides are higher than the transversal sides and that the aligning area passes smoothly into the curved transversal side, arranged nearly vertically to the base plate.

A nearly punctual touching is achieved if the touching point of the aligning element is not a sharp or pointed edge but blunt-edged and with a certain radius, since a sharp or pointed edge can damage the string to be aligned.

Another technical solution of this object is to work out the above-mentioned, third device, so that at least one section of the aligning element being arranged parallely to the base plate has an essentially elliptical shape, whereas the aligning element is preferrably circular in section in its upper part and elliptical in section in its lower part.

This embodiment too touches the string to be aligned essentially punctually thanks to its elliptical section.

The second or third device worked out according to this technical art has the advantage, that the effort needed to align the interlaced network is minimized. On one hand, thanks to the punctual touch between string and aligning element, the friction surface is reduced, minimizing thus the effort needed to align the interlaced network and on the other hand the smooth, that is even transition between aligning and holding area reduces even more the needed effort, since the string is evenly brought back in its original position.

In a preferred embodiment, the outline of the aligning element is an ellipse, whereas its axes correspond at least essentially to the estimated spacing between two opposed strings to be aligned. This entails that, towards the end of the aligning process, when the strings have reached the holding area, they are advantageously located in their estimated position.

In another preferred embodiment, the upper, circular section goes over smoothly into the lower, elliptical section. Thus advantageously, the strings can be aligned evenly and without great effort.

Another technical solution of this object according to the invention is to work out the above-mentioned method so that the aligning element catch first hold of two opposed first strings and align these essentially into their original position before catching hold and aligning the other two opposed strings, whereas the two first strings are essentially maintained in their position while the other two are aligned.

A second and third device worked out according to this state of the art and a method according to this technical teaching presents the advantage, that maximum two strings, usually the two opposed ones of one window, are aligned simultaneously. Thereby, the aligning element catches hold and brings back into its original position the first pair of strings, before catching hold and brining back into its original position the other pair of strings. Accordingly, the force needed for the alignment has to be exerted consecutively and not simultaneously. Although overlapping may occur, the main work of shifting the second pair of strings will only take place after fulfilling the shifting of the first pair of strings. Due to the consecutiveness of the actions, the maximal force needed for the alignment will also be reduced.

In a preferred embodiment of the first or second device according to the invention, the aligning element has a semi-elliptical, semi-circular or pointed-arch-shaped shape. To create a holding area for the already essentially aligned string it is enough, according to the invention, that the tangent to the semi-ellipse, the semi-circle or the pointed arch runs nearly vertically to the base plate.

Thus, the aligning device is advantageously easy to make. The aligning device can thus, in particular, be made by injection moulding, since there is no need for the vertically arranged surfaces, these being difficult to make with the injection moulding method.

A preferred embodiment of the device according to the invention covers the entire stringing. Thus, the aligning device needs only to be inserted once into the stringing to align the whole stringing.

In another preferred embodiment of the device according to the invention, each aligning element has a size adapted to its window. The aligning elements have all different proportions in length and width, so that they can be fitted neatly into the corresponding window of the interlaced network. Thus, the interlaced network can advantageously be aligned with great precision and without big effort.

In order to align the strings correctly, it is enough to provide every fifth or seventh window of each row or column, respectively, with an aligning element. This further reduces the effort and the manufacturing costs.

In another version, more or even less aligning elements can also be foreseen. How many aligning elements are used and which shape is chosen depends on each particular instance, since each player puts a different strain onto the stringing of its racket. As a rule of thumb one can say that the less strain is put onto the interlaced network and the more often it is aligned, the less aligning elements are needed.

It can also be conceived that one device according to the invention is provided with different sorts of aligning elements.

The device according to the invention is easily portable and easy to handle and can be used advantageously to align the stringing of rackets for ball-games, for example of tennis-rackets, squash-rackets, badminton-rackets, and so on.

The device according to the invention can remain in the interlaced network after alignment and can be stored and transported together with the racket in its sheath. Thus, the interlaced network is advantageously maintained permanently in its original position.

Interlaced networks as they are used in the industry, such as sieves, filters, baskets and so on can be advantageously aligned with the device according to the invention.

The device according to the invention can also be used advantageously for cleaning interlaced networks or lattices.

The device according to the invention comprises a base plate, a number of aligning elements to be fastened onto the base plate and, if desired, a handle or a counterplate.

In another preferred embodiment, the base plate is bent, in a marginal area in which no aligning element is provided for, by 5° to 45°, preferrably by 15°. Thus, the player can advantageously and comfortably grasp the aligning device at this place and take it out of the network.

Since each interlaced network has its own structure and each racket in particular its own stringing, each interlaced network and each stringing, respectively, needs its own, individually designed aligning device. This can be achieved for example in making for each type of racket and for each racket stringing, respectively, its own aligning device. In case of interlaced networks manufactured in series and in case of racket stringings in particular, it is appropriate to make the aligning device in one piece, for example by injection moulding.

Such an aligning device manufactured individually for each interlaced network can then be used indefinitely often to align the network. It will guarantee a lasting, easy, fast and precise aligning of the strings without great effort. The aligning device according to the invention can not only be used advantageously in interlaced networks with perpendicular strings, that is to say with rectangular windows, but also in interlaced networks with triangular or rhomboid windows.

Further characteristics of the invention will be explained in the following description of at least one embodiment of the invention in connection with the claims and the drawings. Each characteristic can be realized individually or together with others in embodiments of the invention.

The drawings show embodiments of the invention.

Figure 1:
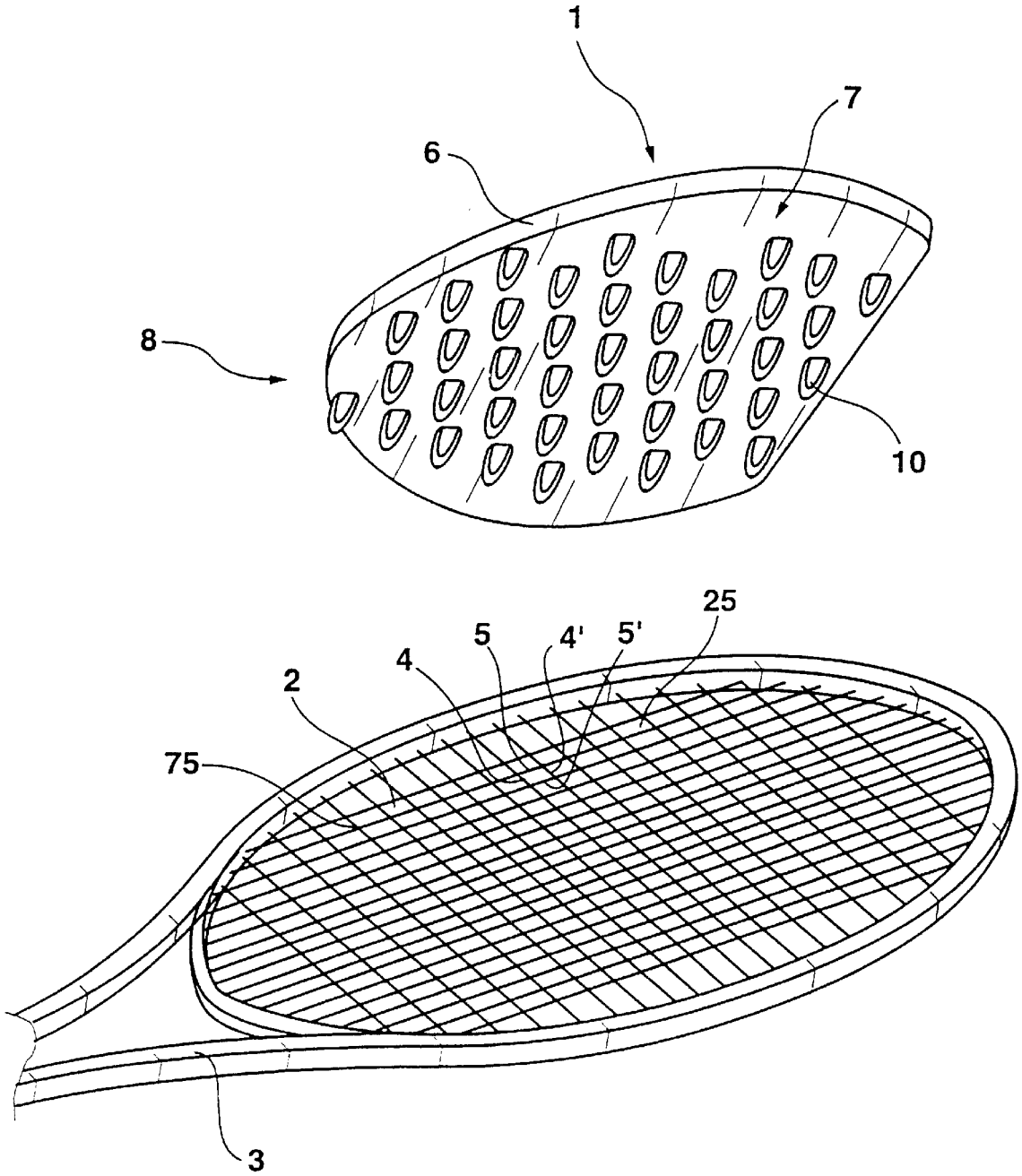
FIG. 1 is a perspective exploded view of an embodiment of the aligning device according to the invention.

The figures of the drawing show the aligning device in a very simplified way and cannot be understood due true to scale.

FIG. 1 shows an aligning device 1 just before it is pressed into the stringing 2 of a tennis-racket 3.

The embodiment of the aligning device 1 shown in FIG. 1 and used for aligning strings 4, 4', 5, 5' of an interlaced network 2 has an even base plate 6, a number of aligning elements 10 arranged in several rows 7 and columns 8 and a handle (not shown). This aligning device 1 can for example be used to align the stringing of a tennis-racket 3.

The geometry of the base plate 6 is adapted to the tennis-racket 3, that is to say that it is even and that its outline corresponds to the main hitting surface of the tennis-racket 3, so that the stringing 2 can be aligned with one aligning process.

In the embodiment shown in FIG. 1, the aligning device 1 is made of one piece. In another embodiment (not shown) the aligning elements 10 are glued unremovably onto the base plate 6.

Figure 2:
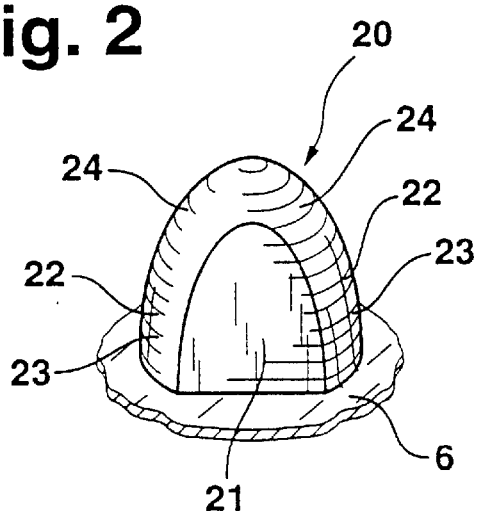
FIG. 2 is a perspective view of an embodiment of an aligning element of the aligning device according to the invention.
Figure 3:
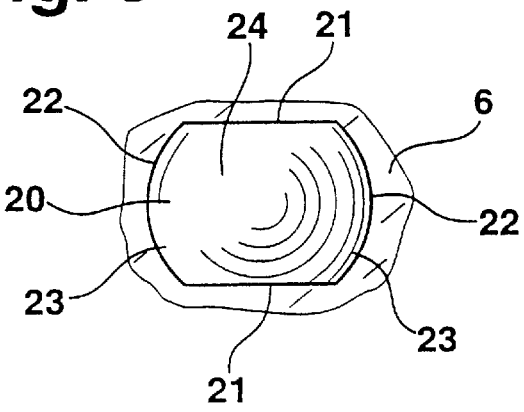
FIG. 3 is a top view of the aligning element according to FIG. 2.

The FIGS. 2 and 3 show an embodiment of an aligning element 20 with a semi-elliptical outline. Two flat sides 21, running parallelly with each other as well as with the longitudinal axis, together with the two curved transversal sides 22 connecting the flat sides 21, form the holding area 23. The transversal sides 22 are curved in such a way that they touch only punctually the strings 4, 4', 5, 5' to be aligned. Thus, except for the flat sides 21, the holding area gets a nearly cylindrical shape. Above the holding area 23, an elliptically or semi-circularly curved aligning area 24 is provided, in which the strings to be aligned 4, 4', 5, 5' are shifted back into their original position before reaching the holding area 23.

A tangent crossing the longitudinal axis can be laid at any place of the aligning area 24 and at any place of the transversal side 22. In the embodiment shown in FIG. 2, this tangent becomes perpendicular to the base plate 6 only in the lower part of the aligning element 20. Although, the tangent is not exactly, but only nearly perpendicular to the base plate in the remaining bottom part of the aligning element 20, a holding area 23 is provided there, since the strings to be aligned 4, 4', 5, 5', are here already essentially in their original position.

In an embodiment not shown, a holding area 23 with a nearly cylindrical shape in the area of the transversal sides 22 adjoins the semi-elliptical or semi-circular aligning area 24. The transversal side 22 running evenly alongside the longitudinal axis is not coaxial with it but bends by a small angle of for example 0,5 to 5 degrees. Thanks to this bending the removal of the aligning device 1 out of the aligned interlaced network 2 is facilitated once the aligning process is achieved.

The flat sides 21 are higher than the transversal sides 22, so that the transition between aligning area 24 and holding area 23 is only at the same level for opposed strings 4, 4' and 5, 5', respectively. Thus the opposed pair of strings 4, 4' and 5, 5' can be aligned essentially consecutively and not simultaneously.

During the aligning process, each aligning element 20 is inserted into a corresponding fitting window 25. Then the aligning area 24 of the aligning element 20 catches hold of two opposed strings 4, 4' and 5, 5', respectively, and brings them back into their original position.

This aligning process is executed in essentially two stages: the aligning stage in the aligning area 24 of the aligning element 20 and the holding stage in the holding area 23 of the aligning element 20. Hereby, the strings 4, 4' are aligned in the aligning area 24. In the flat sides 21 of the holding area of the aligning element 20, which are perpendicular to the base plate 6, the strings 4, 4' are not aligned any more but only maintained in their position, while now the strings 5, 5' are aligned by the aligning area 24. As soon as the strings 5, 5' reach the transversal sides 22, they too are in the holding area 23 of the aligning element 20. In the holding area 23 no noteworthy aligning force is exerted onto the strings 4, 4', 5, 5' so that the holding area 23 is also called the no-force-zone.

On top of the flat sides, the nearly perpendicular to the base plate 6 running transversal sides 22 act as no-force-zones.

The two flat sides 21 running parallely with each other are spaced at a distance corresponding exactly to the estimated spacing of the strings to be aligned 4, 4', whereas the biggest possible spacing between the two transversal sides 22 corresponds to the estimated spacing of the strings to be aligned 5, 5'.

Figure 4:
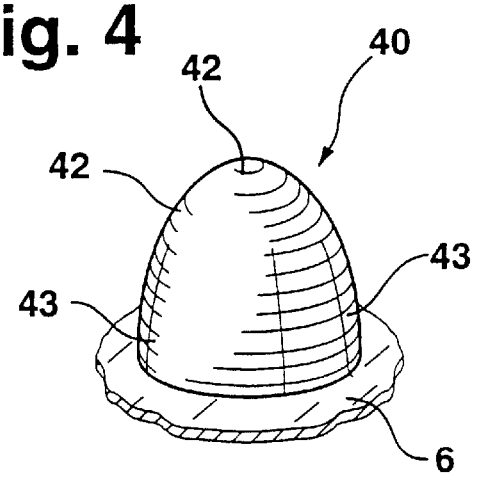
FIG. 4 is a perspective view of another embodiment of an aligning element of an aligning device according to the invention.
Figure 5:
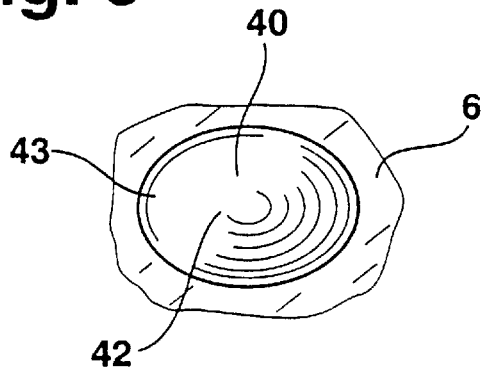
FIG. 5 is a top view of the aligning element according to FIG. 4.

The FIGS. 4 and 5 show a second embodiment of an aligning element 40. The aligning element 40 has, seen from any side, a semi-elliptical outline and any section running parallelly with the base plate 6 has an elliptical shape, whereby the length-ratio of the ellipse-axes of the different sections to each other needs not to remain constant. Thereby, the surface of the sections increases constantly towards the bottom of the aligning element 40.

In an embodiment not shown, the sections in the upper part of the aligning element 40, that is to say near its free end, are circular and change smoothly towards the bottom into sections having an elliptical shape. Thereby, the surface of the sections increases constantly.

In the aligning element 40 according to FIGS. 4 and 5, the axes of the biggest possible ellipse at the bottom of the aligning element 40 correspond to the estimated spacings of the strings to be aligned 4, 4', 5, 5'. The aligning element 40 has, like the aligning element 20, a smooth transition from the aligning area 42 into the holding area 43.

Figure 6:
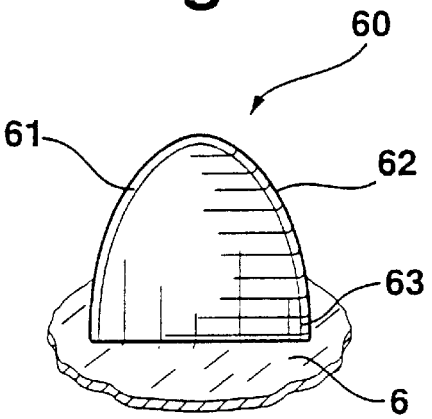
FIG. 6 is a perspective view of another embodiment of an aligning element according to the invention.
Figure 7:
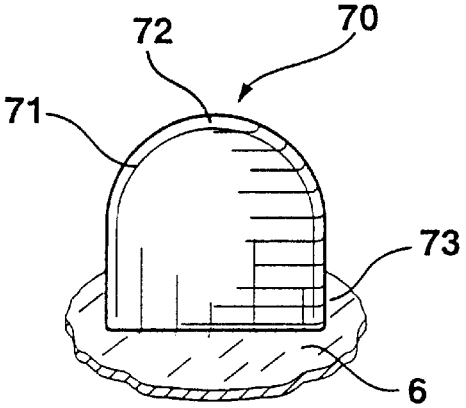
FIG. 7 is a perspective view of still another embodiment of an aligning element according to the invention.

The FIGS. 6 and 7 show two further embodiments of aligning elements 60 and 70 according to the invention, these elements consisting of a flat thin plate with rounded short sides 61, 71. Thanks to the rounded short sides 61, 71, the aligning elements 60, 70 have no sharp edges, which could damage the strings 4, 4', 5, 5'.

The aligning element 60 shown in FIG. 6 has an elliptical outline, whereas the aligning element 70 shown in FIG. 7 has a semi-circular aligning area 72 and a holding area 73 with short sides 71 running perpendicularly to the base plate 6.

In both aligning elements 60 and 70, a curved aligning area 62, 72 passes smoothly into a holding area 63, 73 with its at least nearly parallel short sides 61, 71.

These embodiments catch hold of the strings 4, 4', 5, 5' immediately at their intersection 75 and fit into windows 25 of different size, as will be described in more detail in regard with FIG. 8.

In embodiments not shown, the thin plate is provided in its middle part with supporting crosspieces. The sides of the thin plate can also be arranged obliquely, this enabling an easier manufacturing of the aligning device 1 with the aligning elements 60, 70.

In other, not shown embodiments, a holding brim adjoins the holding area 23, 43, 63, 73 and circumscribes the entire aligning element 20, 40, 60, 70. It is adapted to the flat sides 21.

Figure 8:
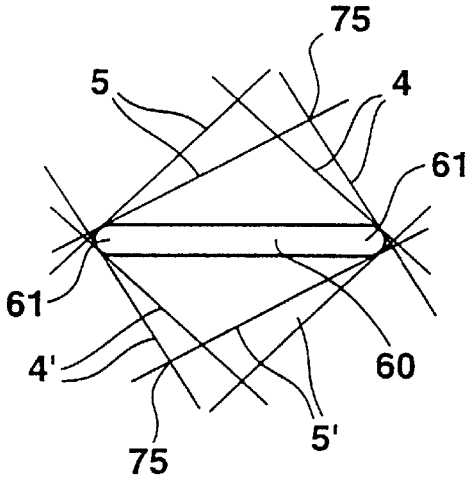
FIG. 8 shows the possibilities to adapt the aligning element according to FIG. 6.

FIG. 8 shows how the aligning elements 60, 70 according to FIGS. 6 and 7 fit into windows 25 of different sizes. These aligning elements 60, 70 area arranged in the diagonal of the window to be aligned 25 and since the windows have approximately a rectangular shape, these windows 25 of different size can indeed have the same diagonal length.

Figure 9:
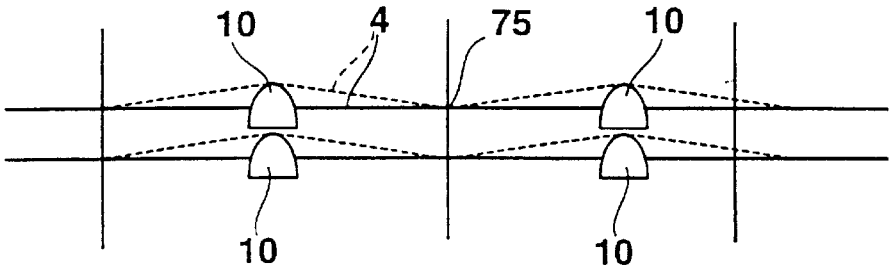
FIG. 9 shows the shifting of a string during the aligning process by means of an aligning element according to FIG. 2 or FIG. 4.

In aligning elements 20, 40 according to FIGS. 2 to 5, which catch hold of the strings 4, 4', 5, 5' at a certain distance from their respective intersection 75, the string 4, 4', 5, 5' is first stretched and taken out of place in the area between two intersections 75, as can be seen from FIG. 9. Only when, at the intersections 75, the stretching force becomes bigger than the friction force, the shifting of the strings 4, 4', 5, 5' occurs.

Figure 10:
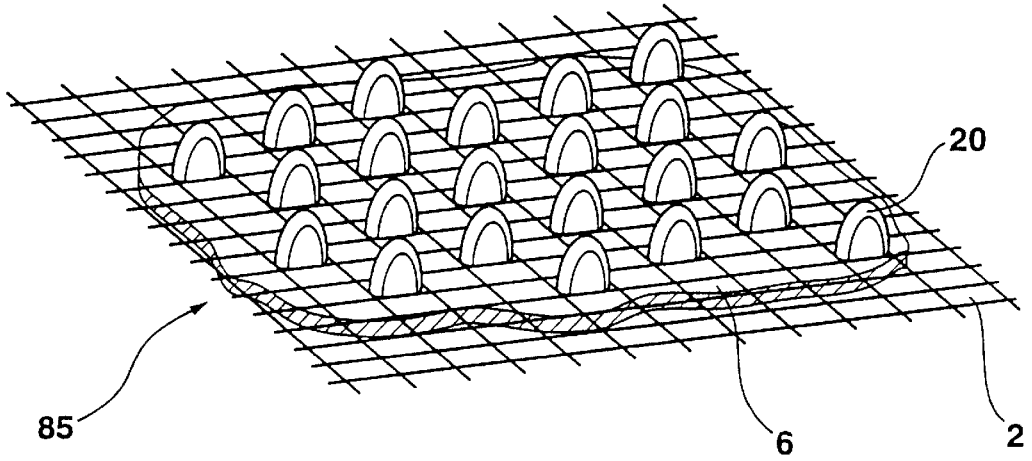
FIG. 10 is a perspective view of part of an embodiment of an aligning device according to the invention.
Figure 11:
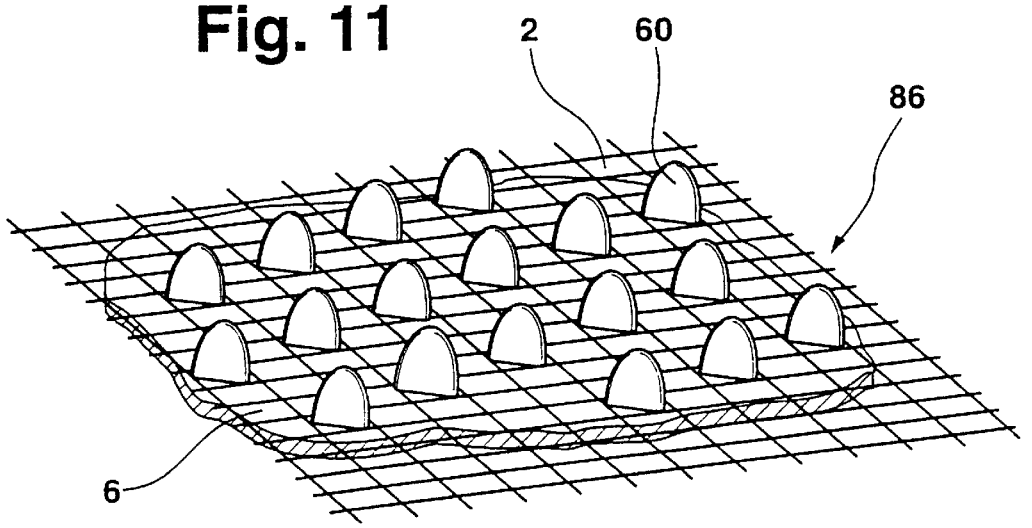
FIG. 11 is a perspective view of part of another embodiment of an aligning device according to the invention.

The FIGS. 10 and 11 show further embodiments of the aligning device according to the invention.

FIG. 10 shows part of an aligning device 85 inserted into an interlaced network 2. This aligning device 85 has aligning elements 20 according to FIGS. 2 and 3. Hereby, an aligning element 2 is only provided in every fifth window 25 of a row 7 and in every fifth window of a column 8.

FIG. 11 shows part of an aligning device 86 inserted into an interlaced network. This aligning device 86 has aligning elements 40 according to FIG. 6. Hereby, an aligning element 20 is only provided in every seventh window 25 of a row 7 and in every seventh window of a column 8.

The aligning devices 1, 85, 86 are made of light alloy, ceramics, acryl, wood, hard synthetic rubber or of a combination of one or several of these materials.

We claim:

1. A device for bringing into alignment the strings (4, 4', 5, 5') of an interlaced network (2) with a base plate (6) and at least one aligning element (60, 70), whereas the aligning element (60, 70) is designed as a thin plate between generally parallel spaced flat sides (21) which catches hold of the strings (4, 4', 5, 5') near their intersection (75), wherein the aligning element (60, 70) has rounded sides (61, 71) extending laterally between said flat sides and that the rounded sides (61, 71) pass smoothly, in a direction toward said base plate, from a curved aligning area (62, 72) for string (4, 4', 5, 5') alignment into a holding area (63, 73) where said rounded sides (61, 71) extend in a generally perpendicular direction to the base plate (6), said curved aligning areas being curved elliptically or semi-circularly in a direction from a top or outer end of said aligning element towards a bottom of said aligning element which is fixed to said base plate and in a direction generally perpendicular to said base plate.

2. A device according to claim 1, wherein the alignment element (10, 20, 60, 70) has a semi-elliptical, semi-circular or pointed-arch-shaped outline.

3. A device for aligning strings (4, 4', 5, 5') of an interlaced network (2) with a base plate (6) and a number of aligning elements (40) mounted to the base plate according to claim 1 wherein said aligning elements are shaped either semi-elliptical, semi-circular or of the shape of a tapered pointed arch, excluding a circle, such that at least a section of each rounded side of each aligning element (40) extending toward the base plate (6) has essentially an elliptical shape.

4. A device according to claim 3 wherein said aligning element (40) has, in a direction toward said base plate, a generally elliptical shape, whereby the axes of the ellipse correspond to at least essentially the estimated spacing between two opposed strings (4,4',5,5') to be aligned.

5. A device according to claim 1 wherein each alignment element (10,20,40,60,70) has a size corresponding to the window between adjacent strings.

6. A device according to claim 3, wherein the aligning elements (10, 20, 40, 60, 70) are arranged onto the base plate (6) in such a way that they fit into every second, fifth or seventh window (25) of a row (7) or column (8), respectively.

7. A device according to claim 3, wherein the aligning device (1, 85, 86) covers nearly the entire stringing surface.

8. A device according to claim 3, wherein the aligning device (1, 85, 86) is made of one piece.

9. A device according to claim 3, wherein the base plate (6) has marginal area which is bent outwardly from a plane of the base plate at an angle of from 5° to 45° to provide a gripping area for gripping the base plate to remove the aligning device from an interlaced network.

10. A device according to claim 1, wherein the alignment elements are arranged onto the base plate in such a way that they fit into every second, fifth or seventh window or a wall or column, respectively.

11. A device according to claim 1, wherein the aligning device covers nearly the entire string surface.

12. A device according to claim 1, wherein the aligning device is made of one piece.

13. A device according to claim 1, wherein the base plate (6) has marginal area which is bent outwardly from a plane of the base plate at an angle of from 5° to 45° to provide a gripping area for gripping the base plate to remove the aligning device from an interlaced network.

14. A device for bringing into alignment the strings (4, 4', 5, 5') of an interlaced network (2) with a base plate (6) and at least one aligning element (10, 20), whereas the aligning element (10, 20) has a tapered aligning area (23) for aligning the strings (4, 4', 5, 5'), said aligning area (23) extending in a curve downwardly to the base plate (6) in such a way that the aligning element (10, 20) touches the string to be aligned (4, 4' 5, 5') gradually, and has a holding area with rounded sides of short width between two generally parallel spaced flat sides (21) for holding at least one string (4, 4' 5, 5'), the aligning area (24) being curved elliptically or semi-circularly in a direction downwardly toward said base plate, the holding area (23) having two sides (22) connecting the flat sides (21), these sides (22) being curved to touch the strings to be aligned (4, 4' 5, 5') gradually, the flat sides (21) being higher than the curved sides (22) and the aligning area (24) extending in a smooth transition into the curved side (22), said elliptical or semi-circular aligning areas extending in a direction from a top or outer end of said aligning element towards a bottom of said aligning element which is fixed to said base plate and in a direction generally perpendicular to said base plate.

15. A device according to claim 14, wherein the alignment elements are arranged onto the base plate in such a way that they fit into every second, fifth or seventh window or a wall or column, respectively.

16. A device according to claim 14, wherein the aligning device covers nearly the entire string surface.

17. A device according to claim 14, wherein the aligning device is made of one piece.

18. A device according to claim 14, wherein the base plate (6) has marginal area which is bent outwardly from a plane of the base plate at an angle of from 5° to 45° to provide a gripping area for gripping the base plate to remove the aligning device from an interlaced network.

* * * * *